US005647267A

United States Patent [19]

Kim

[11] Patent Number: 5,647,267

[45] Date of Patent: Jul. 15, 1997

[54] SLIDER OF HERMETIC COMPRESSOR

[75] Inventor: Dhong-Hyeon Kim, Seoul, Rep. of Korea

[73] Assignee: LG Electronics Inc., Rep. of Korea

[21] Appl. No.: 585,108

[22] Filed: Jan. 11, 1996

[30] Foreign Application Priority Data

Jun. 13, 1995 [KR] Rep. of Korea ..... 15618/1995

[51] Int. Cl.[6] ..... F01B 9/00

[52] U.S. Cl. ..... 92/140; 74/50; 92/261

[58] Field of Search ..... 74/50; 92/187, 92/140, 84; 384/42

[56] References Cited

U.S. PATENT DOCUMENTS 3,735,741 5/1973 Hatz ..... 92/72

5,485,777 1/1996 Kim ..... 92/84

*Primary Examiner*—Thomas E. Denion

*Attorney, Agent, or Firm*—Ostrolenk, Faber, Gerb & Soffen, LLP

[57] ABSTRACT

A slider of a closed-type compressor in which friction and abrasion of an inside circumferential surface of a slider shell and an outside circumferential surface of the slider can be reduced by forming a circular arc at both portions where the outside circumferential surface of the slider contacts the inside circumferential surface of the slider shell. The slider of the closed-type compressor has a circular arc portion at the inside portion of both ends of the outside circumferential surface of the slider and both outside portions of a central groove of the slider, respectively.

2 Claims, 5 Drawing Sheets

CONVENTIONAL. ART

SLIDER OF HERMETIC COMPRESSOR

BACKGROUND OF THE INVENTION

The present invention relates to a slider of a closed-type compressor, and more particularly to a slider of a closed-type compressor in which friction and abrasion of an inside circumferential surface of a slider shell and an outside circumferential surface of the slider can be reduced by forming a circular are at both portions where the outside circumferential surface of the slider contacts the inside circumferential surface of the slider shell.

As shown in FIG. 1, in a conventional closed-type compressor, a rotation shaft 2 penetrates a central portion of a rotor 1 and is integrally united with rotator 1 by shrink fit.

As shown in FIG. 2, a counter balance weight 3 is combined at the upper portion of rotation shaft 2, and an eccentric crank pin 4 is fixed at a predetermined portion of the upper surface of counter balance weight 3. Crank pin 4 is associated with a slider 5. A central groove 5*a* having a predetermined width is formed along the outside circumference of the central portion of slider 5. At a predetermined portion of central groove 5*a*, a pin hole 5*b* for inserting crank pin 4 is formed. Also, slider 5 is enclosed by a slider shell 6 so that slider 5 reciprocates inside slider shell 6 according to the rotation of rotation shaft 2.

In the meantime, a piston 7 is welded to one side of slider shell 6. Since piston 7 is guided by cylinder 8, piston 7 linearly reciprocates inside cylinder 8 according to the rotation of the crank shaft. A frame 9 is installed around rotation shaft 2, and a plurality of oil-supplying central grooves 10 is formed on an outside circumferential surface of rotation shaft 2.

Meanwhile, as shown in FIG. 3A and 3B, in the conventional closed-type compressor, slider 5 contacting the inside circumferential surface of slider shell 6 is shaped linearly exclusive of a chamber at each end portion thereof.

When power is supplied to the conventional compressor of such structure, rotation shaft 2 which is rotatably assembled by rotor 1 by shrink fit rotates and eccentric crank pin 4 associated with counter balance 3 rotates, accordingly. Thus, slider 5 united with crank pin 4 moves forward and backward inside slider shell 6. Here, according to the forward and backward movements of slider 5, piston 7 integrally united with slider shell 6 reciprocates inside cylinder 8.

Due to a centrifugal force generated as rotation shaft 2 rotates, oil 11 (See FIG. 2) is absorbed upward along a plurality of oil-supplying central grooves 10 and supplied for lubricating friction portions between slider 5 and slider shell 6 and piston 7 and cylinder 8.

A reference numeral 30 of FIG. 4 shows a fluid pressure generated during an operation of a conventional closed-type compressor.

However, when the slider of the conventional closed-type compressor reciprocates inside the slider shell, as shown in FIG. 4, a low fluid pressure (experimental maximum value of 0.05 MPa) occurs on a lubrication surface of the slider and the slider shell. Thus, the outside circumferential surface of the slider is in direct contact with the inside circumferential surface of the slider shell, causing serious abrasion.

SUMMARY OF THE INVENTION

To solve the above problems, it is an object of the present invention to provide the slider of a closed-type in which abrasion caused by friction between the outside circumferential surface of the slider and the inside circumferential surface of the slider shell by forming a high fluid pressure at the outside circumferential surface of the slider.

Accordingly, to achieve the above object, there is provided a slider of a closed-type compressor comprising: a rotation shaft penetrating a central portion of a rotor and being integrally united with the rotor by shrink fit and having a plurality of oil-supplying grooves formed on the outside circumferential surface thereof; a counter balance weight combined at the upper portion of the rotation shaft; an eccentric crank pin fixed at a predetermined portion of the upper surface of the counter balance weight; a slider associated with the crank pin and having a central groove formed along the outside circumference of the central portion thereof; a slider shell enclosing the slider; a cylinder installed at one side of the slider shell; and a piston connecting a predetermined portion of the slider shell with the cylinder and linearly reciprocates inside the cylinder, in which a circular arc is formed at both ends of the outside circumferential surface of the slider contacting the inside circumferential surface of the slider shell.

It is preferred in the present invention that a circular are is formed at both outer portions of the central groove on the outside circumferential surface of the slider.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Since the structure of the closed-type compressor of the present invention is the same as that of the conventional technology except the shape of the slider, only a structure of the slider will be described, hereunder.

Figure 1:
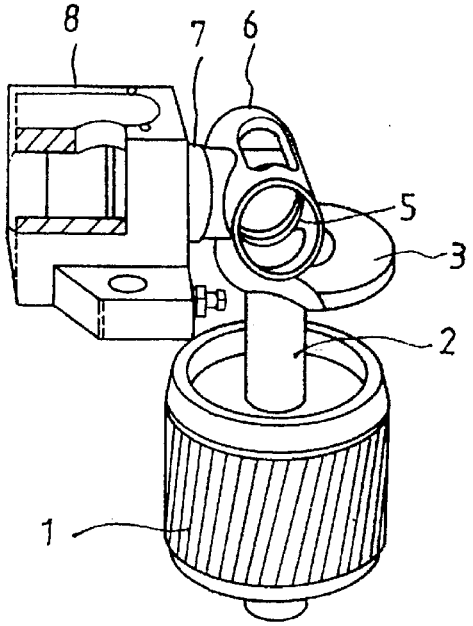
FIG. 1 CONVENTIONAL ART
FIG. 1 is a perspective view illustrating a compressing portion of the conventional closed-type compressor.
Figure 2:
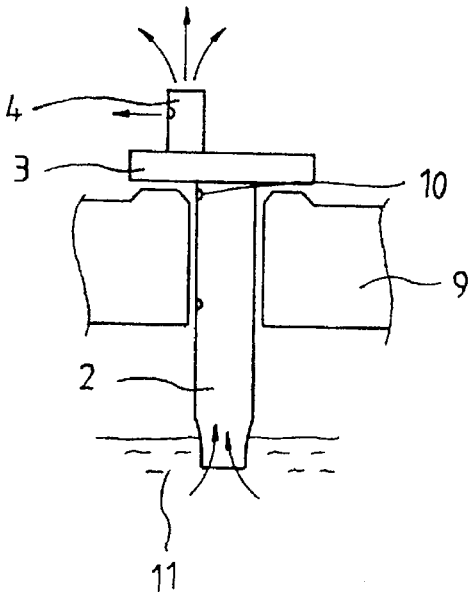
FIG.2 CONVENTIONAL ART
FIG. 2 is a schematic illustrating a state where the rotation shaft of the conventional closed-type compressor is united with the frame.
Figure 3A:
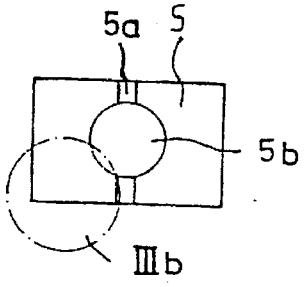
FIG.3A CONVENTIONAL ART
FIG. 3A is a schematic plan view illustrating the slider of the conventional closed-type compressor.
Figure 3B:
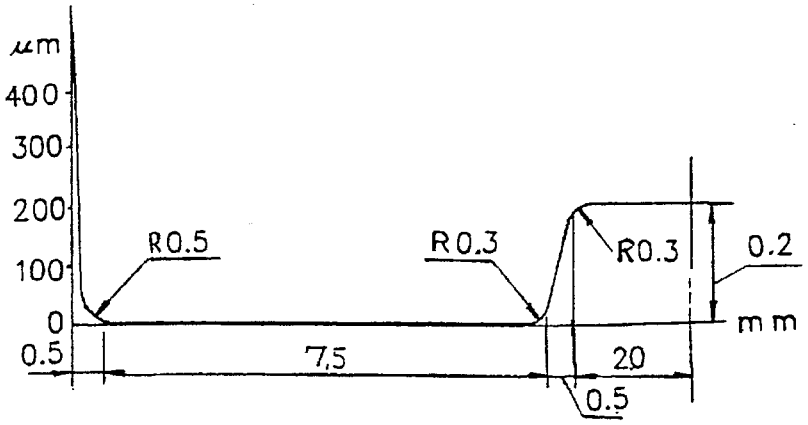
FIG. 3B is an amplified view illustrating a portion IIIb of FIG. 3A.
Figure 4:
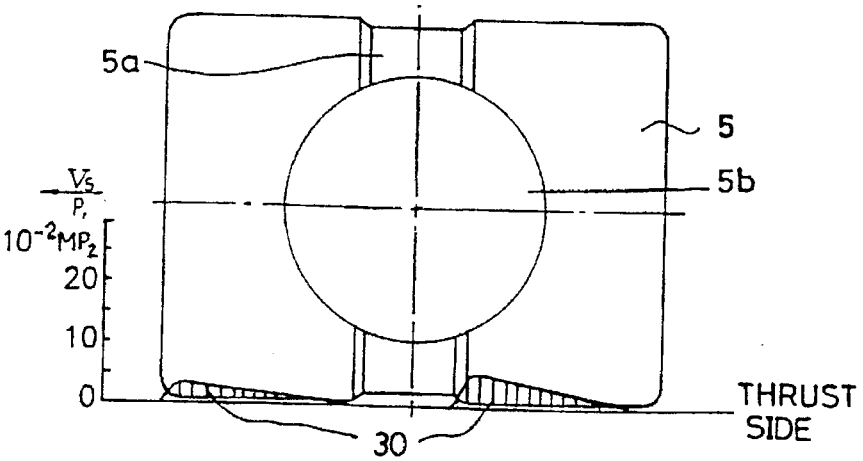
FIG. 4 CONVENTIONAL ART
FIG. 4 is a plan view illustrating the slider of the conventional closed-type compressor in case that a fluid pressure is generated during the operation of the slider.
Figure 5A:
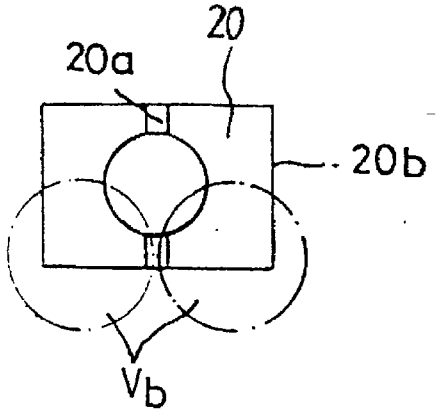
FIG. 5A is a schematic plan view illustrating a slider of a closed-type compressor according to the present invention.
Figure 5B:
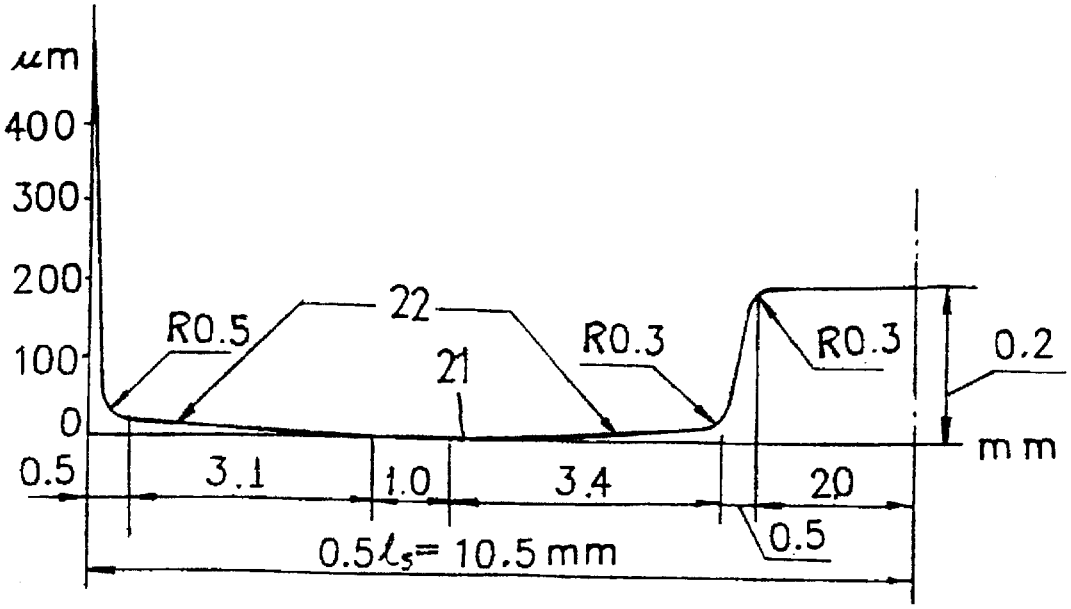
FIG. 5B is an amplified view illustrating a portion Vb of FIG. 5A.

The structure of the slider of the compressor according to the present invention is as shown in FIGS. 5A and 5B. A central groove 20*a* is formed along the circumference of the central portion of the slider with a predetermined width. A pin hole in which a crank pin (not shown) is inserted is formed at a predetermined portion of central groove 20*a*. A circular arc 22 is respectively formed at both ends of contact portion 21 of the outside circumferential surface of slider 20 which slides and reciprocates on the inside circumferential surface of a slider shell (not shown), i.e., at the inside portions of both ends 20*b* of the outside circumferential surface of slider 20 and both outside portions of central groove 20*a*.

Figure 6:
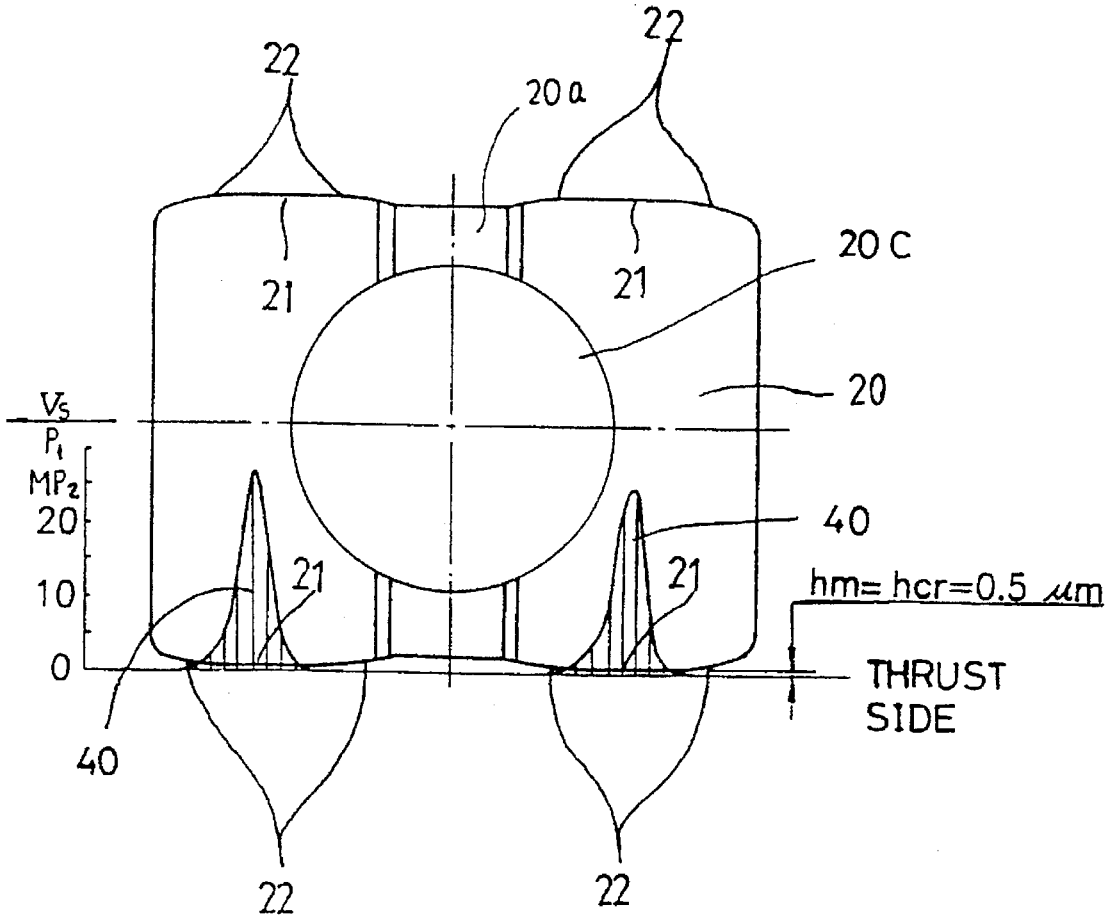
FIG. 6 is a plan view of the slider of the closed-type compressor of the present invention in case that the fluid pressure is generated during the operation of the slider.

When a power is supplied to the slider of the compressor having such a structure and the compressor starts to operate, slider 20 slides inside the slider shell and performs reciprocation. Here, due to oil supplied to a fiction-generating portion between the inside circumferential surface of the slider shell and the outside circumferential surface of slider 20, a high fluid pressure (about 30 MPa of the experimental maximum value) is generated, as shown in FIG. 6, and thus, a slider weight support capacity on a lubrication surface is increased.

Figure 7:
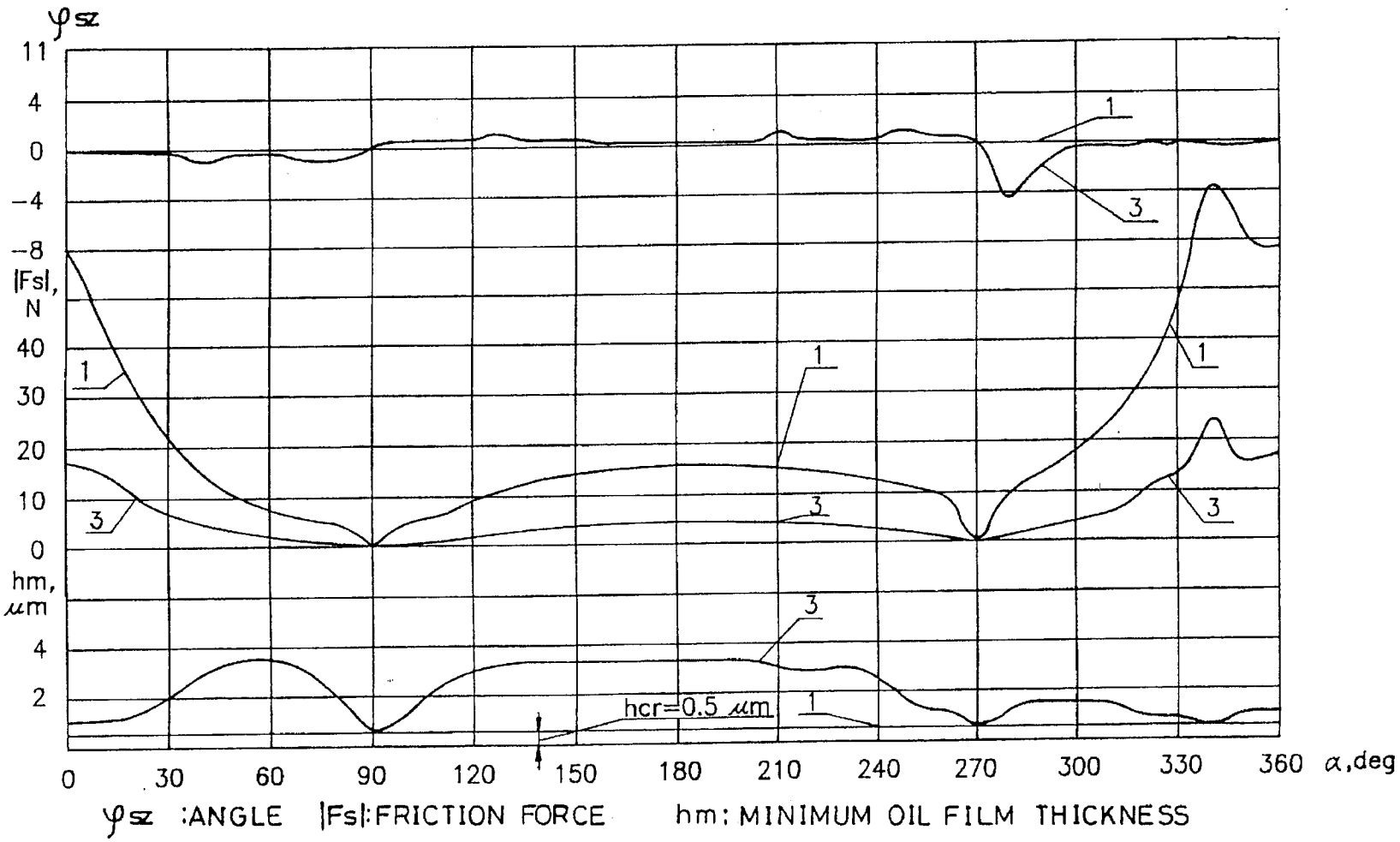
FIG. 7 is a graph indicating a fine movement angle, a size of a friction force and a minimum oil film thickness of each slider according to the present invention and conventional technology.

FIG. 7 shows a comparison between functions of the slider according to the present invention and the conventional technology when a rotation shaft (not shown) rotates a turn, and particularly, values of a fine movement angle, a size of a friction force and a minimum oil film thickness are compared. In FIG. 7, reference numerals 1 and 3 denote values of the conventional slider and the present slider, respectively.

The maximum value of a friction force between the slider shell and slider 20 was in the conventional art 60N, but in the present invention, it is reduced to 17N.

Also, the minimum oil film thickness generated in slider 20 during the one turn of the rotation shaft was previously 0.5 μm which means the slider shell and the slider are closely contacting each other. However, the present invention exhibits the oil thickness of over 0.5 μm so that pressure of the fluid can be enough to support the slider. Thus, it can be noted that both the inner side of the slider shell and the outer side of slider 20 are lubricated without contacting each other.

Also, as to the fine movement angle of the slider, the conventional slider reciprocates while the slider shell and the slider are nearly contacting each other so that the fine movement are hardly shown.

A reference numeral 40 of FIG. 6 denotes fluid pressure generated during operation of the closed-type compressor of the present invention.

As described above, in the slider of the closed-type compressor of the present invention, the circular arc portion is formed on the outside circumferential surface of the slider contacting the inside circumferential surface of the slider shell so that a high fluid pressure is formed at the outside circumferential surface of the slider and the inside circumferential surface of the slider shell when the outside circumferential surface of the slider slides on the inside circumferential surface of the slider shell. Thus, the friction and abrasion between the outside circumferential surface of the slider and the inside circumferential surface of the slider shell are reduced. Also, a mechanical efficiency of the compressor is improved, and the reliability of parts of the compressor slider are enhanced.

What is claimed is:

1. A slider of a hermetic compressor comprising:

a rotation shaft vertically penetrating a central portion of a rotor and assembled to said rotor by shrink fit, rotator up and down and integrally united with the rotator as said rotation shaft having a plurality of oil grooves formed on an outside circumferential surface thereof;

a counter balance weight attached to an upper portion of said rotation shaft;

an eccentric crank pin fixed at a predetermined portion of an upper portion of said counter balance weight;

a slider associated with said crank pin and having a central groove formed along an outside circumference of a central portion thereof;

a slider shell enclosing said slider;

a cylinder installed at one side of said slider shell; and a piston connecting a predetermined portion of said slider shell with said cylinder and linearly reciprocating inside said cylinder, wherein a circular arc is formed at both ends of an outside circumferential surface of said slider contacting an inside circumferential surface of said slider shell.

2. A slider of a hermetic compressor as claimed in claim 1, wherein said circular arc is further formed at both outer portions of the a central groove on the outside circumferential surface of said slider.

* * * * *